US007662529B2

(12) United States Patent
Yamazaki

(10) Patent No.: US 7,662,529 B2
(45) Date of Patent: Feb. 16, 2010

(54) ELECTROPHOTOGRAPHIC PHOTOCONDUCTOR

(75) Inventor: Mikio Yamazaki, Nagano (JP)

(73) Assignee: Fuji Electric Device Technology Co., Ltd., Tokyo (JP)

( * ) Notice: Subject to any disclaimer, the term of this patent is extended or adjusted under 35 U.S.C. 154(b) by 573 days.

(21) Appl. No.: 11/520,038

(22) Filed: Sep. 13, 2006

(65) Prior Publication Data

US 2007/0087278 A1 Apr. 19, 2007

(51) Int. Cl.
*G03G 15/02* (2006.01)

(52) U.S. Cl. ..... 430/59.4

(58) Field of Classification Search ..... 430/59.4
See application file for complete search history.

(56) References Cited

U.S. PATENT DOCUMENTS

| | | | | |
|---|---|---|---|---|
| 2,297,691 | A | 10/1942 | Carlson et al. | |
| 3,816,118 | A | 6/1974 | Byrne | |
| 3,825,422 | A | 7/1974 | Gruber et al. | |
| 5,736,282 | A | 4/1998 | Tamura et al. | |
| 6,300,026 | B1 * | 10/2001 | Yamazaki et al. | 430/56 |
| 2006/0134541 | A1 * | 6/2006 | Fujii et al. | 430/74 |

FOREIGN PATENT DOCUMENTS

| | | |
|---|---|---|
| JP | 53-89433 | 8/1978 |
| JP | 57-148745 | 9/1982 |
| JP | 2806567 | 7/1998 |
| JP | 2812729 | 8/1998 |
| JP | 2886493 | 2/1999 |
| JP | 2000-258939 | 9/2000 |

OTHER PUBLICATIONS

"Oxo-phthalocyaninato-titan(IV) (PcTiO)", by W. Hiller and had a specific gravity of 1.57 (W. Hiller et al., Z. Kristallogr. vol. 159, pp. 173-183 (1982).

* cited by examiner

*Primary Examiner*—Mark A Chapman
(74) *Attorney, Agent, or Firm*—Rabin and Berdo, P.C.

(57) ABSTRACT

An electrophotographic photoconductor in which generation of a ghost phenomenon caused by exposure is avoided and potential change before and after continuous printings is insignificant. A functionally separated type electrophotographic photoconductor includes at least a charge generation layer containing a charge generation agent and a charge transport layer containing a charge transport agent, the two layers being sequentially laminated on a conductive substrate. A ratio of the maximum intensity of a halo pattern to a peak intensity of a maximum diffraction peak is less than 0.3 in an X-ray diffraction pattern obtained by a powder method using Cu Kα line of a test coating film produced from a test coating liquid that is prepared by adding the charge transport agent into a coating liquid for the charge generation layer in an equal mass of the charge transport agent to a mass of the charge generation agent.

19 Claims, No Drawings

ELECTROPHOTOGRAPHIC PHOTOCONDUCTOR

CROSS-REFERENCE TO RELATED APPLICATION

This application is based on, and claims priority to, Japanese Patent Application No. 2005-299913, filed on Oct. 14, 2005, the contents of which are incorporated herein by reference.

BACKGROUND OF THE INVENTION

1. Field of the Invention

The present invention relates to an electrophotographic photoconductor, in particular, to an electrophotographic photoconductor exhibiting improved image quality and reduced likelihood of causing ghost phenomena due to exposure.

2. Description of the Related Art

Image formation using an electrophotographic system is diversely applied to copiers, printers, plotters and complex digital imaging machines combining the functions of these machines in an office, and recently also to small-sized printers and facsimile machines for personal use. Many types of photoconductors for these electrophotographic apparatuses have been developed since the invention by Carlson (U.S. Pat. No. 2,297,691). Photoconductors these days generally use organic material.

There is a type of photoconductor, known as a functionally separated photoconductor, which consists of an undercoat layer, a charge generation layer, a charge transport layer, and, as required, a protective layer, these layers being laminated on a conductive substrate. The conductive substrate can be made of aluminum or the like. The undercoat layer can be, for example, an anodized film or a resin film. The charge generation layer may contain an organic pigment exhibiting a photoconductive property, such as phthalocyanines or azo pigments. The charge transport layer contains a molecule having a partial structure that involves hopping conduction of charges, such as a molecule of amine or hydrazone that bonds with conjugated $\pi$ electrons. Another type of known photoconductor, a single layer type photoconductor, comprises a photosensitive layer exhibiting both charge generating and charge transporting functions and a protective layer that are laminated on an undercoat layer.

Each layer composing the photoconductor is normally formed, because of mass-production, by dipping and coating a conductive substrate in a coating liquid prepared by dissolving or dispersing a pigment, a charge generation agent, to exhibit a charge generation or light scattering function, or a charge transport agent to exhibit a charge transport function.

In a so-called reverse development process that is primarily employed in recent electrophotographic apparatuses, an exposure light source uses a semiconductor laser or a light emitting diode with an oscillation wave length ranging from 450 nm to 830 nm; digital signals of a picture or characters are transformed into optical signals; the light is irradiated on an electrified photoconductor to form an electrostatic latent image on the photoconductor surface; and the latent image in turn is visualized by toner.

Phthalocyanines, among charge generation agents, have been extensively studied because the phthalocyanines have larger light absorbing capability in the oscillation wave length region of semiconductor lasers than other charge generation agents, thus exhibit excellent charge generation ability. Known photoconductors use a variety of phthalocyanines having a central atom of copper, aluminum, indium, vanadium, or titanium (see Japanese Unexamined Patent Publication S53-89433; U.S. Pat. No. 3,816,118; Japanese Unexamined Patent Publication S57-148745; and U.S. Pat. No. 3,825,422).

Electrical characteristics of a photoconductor having laminated organic films are controlled by the contact conditions between a charge generation substance and a charge transport substance included in different layers at the interface between the layers, as well as by the properties of each layer. The injection characteristic of carriers in particular, is affected by the structure of the interface.

If charge injection from a charge generation layer into a charge transport layer is inhibited due to inhomogeneity in the interface structure and the charges are accumulated around the interface, an image defect such as so-called image memory appears. Therefore, it is important from the viewpoint of image quality to achieve an adequate interface structure. If a photoconductor surface including an inadequate interface structure is once exposed, charge accumulation occurs at the interface between the charge generation layer and the charge transport layer in this region. When the photoconductor surface of this region is electrified afterwards, the charges accumulated in the vicinity of the interface are released, or the photo-induced carriers generated in the charge generation layer are deactivated, which causes a ghost phenomenon upon exposure. Negative memory occurs in the case of excessive carriers for neutralizing surface charges, and positive memory occurs in the case of deficient carriers.

In order to improve resolution of an image, a charge transport agent with low mobility is often selected for suppressing lateral movement of holes in the photoconductor, or the concentration of the charge transport agent in the films is controlled to be low.

However, if a charge transport agent with low mobility is selected, the temperature dependence of the photoconductor surface potential increases, and if the concentration of the charge transport agent is reduced, a drawback of increased residual potential arises in addition to the above mentioned defects. These defects further increase the ghost phenomena caused by exposure.

SUMMARY OF THE INVENTION

In light of the above-described problems in the prior art, an object of the present invention is to provide an electrophotographic photoconductor that does not generate a ghost phenomenon caused by exposure and gives little potential change between before and after continuous printings.

To solve the problem and achieve the object of the invention, the inventor of the present invention has made extensive studies and found that the problem of a ghost phenomenon caused by exposure can be eliminated by the featured construction as described below.

An electrophotographic photoconductor according to the invention is a functionally separated type electrophotographic photoconductor including at least a charge generation layer containing a charge generation agent and a charge transport layer containing a charge transport agent that are sequentially laminated on a conductive substrate, where an intensity ratio is less than 0.30, the intensity ratio being a ratio of the maximum intensity of a halo pattern to a peak intensity of a maximum diffraction peak in an X-ray diffraction pattern obtained by a powder method using Cu K$\alpha$ line of a test coating film produced from a test coating liquid that is prepared by adding the charge transport agent into a coating liquid for the charge generation layer in an equal mass of the charge transport agent to a mass of the charge generation agent. A charge generation agent and a charge transport layer in an electrophotographic photoconductor of the invention satisfy the above-defined condition.

A charge generation agent in an electrophotographic photoconductor of the invention is preferably a titanylphthalocyanine having a crystal form classified to phase II as studied by W. Hiller. A charge transport agent in an electrophotographic photoconductor of the invention is preferably formed by a dip coating method.

The reason for eliminating a ghost phenomenon caused by exposure and enhancing resolution is not exactly clarified but can be attributed to the following mechanism. In the process of forming a photosensitive thin film by dip coating, particularly in the case of forming a charge transport layer subsequently to a charge generation layer, the previously formed charge generation layer contacts to the coating liquid for the charge transport layer and may partly dissolve into the solvent in the coating liquid for the charge transport layer. In the region of dissolved charge generation layer, the pigment in the charge generation material is exposed to the solvent of the coating liquid for charge transport layer and the binder resin is removed. As a result, the charge generation agent and the charge transport agent have a chance to directly interact each other.

In this interaction, some type of molecular structure of the charge transport agent allows a part of the charge transport agent molecules to enter through the crystals of the pigment particles of the charge generation agent and can make a part of the crystals transform into an amorphous state. The amorphous layer formed thereby is different in charge generation capability from a region not transformed to an amorphous state. Thus, inhomogeneity in charge injection performance occurs, causing a ghost phenomenon due to exposure.

The inventor of the present invention has studied the extent of the amorphous state by means of X-ray diffraction measurement on test pieces (test coating films) produced from test coating liquid prepared by adding and dissolving a charge transport agent into a coating liquid for charge generation layer, and has confirmed the interaction between the charge generation pigment and charge transport molecules. The study has shown that good images are formed when the intensity of halo pattern is low in the X-ray diffraction pattern of the charge generation pigment, which means the extent of amorphous state is low in the charge generation pigment.

The extent of the amorphous state is very small in the coating film in the actual process and cannot be exactly determined by X-ray diffraction measurement on a practical photoconductor product. In addition, there is no means to exactly detect the extent of the amorphous state in a practical dip coating process. Accordingly, the extent of the amorphous state must be amplified for detection by means of the test method specified above as in this invention.

Owing to the above specified feature of the invention, an electrophotographic photoconductor has been provided in which ghost phenomena caused by exposure are reduced and potential change is small between before and after continuous printings.

DETAILED DESCRIPTION OF THE INVENTION

Now, some preferred embodiments according to the invention will be described in detail as follows.

An electrophotographic photoconductor of the invention is a functionally separated type electrophotographic photoconductor comprising at least a charge generation layer containing a charge generation agent and a charge transport layer containing a charge transport agent, both layers being sequentially laminated on a conductive substrate.

A charge generation layer and a charge transport layer in a photoconductor according to the invention are necessarily prepared to satisfy the following condition. An intensity ratio of the maximum intensity of a halo pattern to a peak intensity of a maximum diffraction peak is less than 0.30 in an X-ray diffraction pattern obtained by a powder method using Cu Kα line of a test coating film produced from a test coating liquid that is prepared by adding the charge transport agent into a coating liquid for the charge generation layer in an equal mass of the charge transport agent to a mass of the charge generation agent. A smaller value of this intensity ratio, or approaching to zero, indicates that the crystal form of the charge generation pigment is better and more favorable.

The X-ray diffraction measurement in the invention can be conducted by a powder method using a radiation source of Cu Kα line. A thin film specimen for the measurement, a test coating film, can be obtained by so-called a casting method to form a film with an adequate thickness. In this method, test coating liquid is prepared by adding a charge transport agent into coating liquid for a charge generation layer in the same mass as the charge generation agent. The test coating liquid is dropped on a substrate of a plate of aluminum or glass, and dried. The thickness of the test coating film is enough if a sufficient diffraction intensity is obtained to allow analysis in an X-ray diffraction measurement by a powder method, and considering adhesiveness with the substrate and ease of film formation, the thickness is preferably around 1 mm. To ensure adhesiveness between the substrate and the coating film, an undercoat layer thinner than about 1 μm can be provided on the substrate by casting a solution of nylon (a polyamide) dissolved in an appropriate solvent.

The intensity ratio of the maximum intensity of a halo pattern to the maximum peak intensity in the present invention is determined as follows. The intensity ratio determined in this method is defined as the intensity ratio of the maximum intensity of a halo pattern to the maximum peak intensity in the present invention.

First, a coating liquid for a charge generation layer is prepared and divided into two equal parts. The solid component of one of the two partial liquids is measured to obtain a weight concentration of the charge generation agent in the liquid. Then, the charge transport agent that is contained in a coating liquid used for a charge transport layer in a practical photoconductor product is added in the partial coating liquid so that the weight concentration of the charge generation agent is equal to the weight concentration of the charge transport agent. Thus, a test coating liquid is prepared. The charge transport agent is not added into the other partial coating liquid. These two types of coating liquid are used to produce two types of casting films under the same conditions. X-ray diffraction patterns are measured on these casting films by a powder method. Each measured diffraction pattern is normalized by the maximum peak intensity value. The diffraction intensity distribution of the normalized diffraction pattern of the coating liquid obtained without adding the charge transport agent is subtracted from the diffraction intensity distribution of the normalized diffraction pattern of the test coating liquid obtained by adding the charge transport agent.

The maximum value of the thus obtained subtracted diffraction pattern is defined as an intensity ratio of the maximum intensity of a halo pattern to the maximum peak intensity in the present invention. The peaks with a half width of not. more than one degree that appear on the subtracted diffraction pattern are considered to be resulted from crystallized parts and excluded from the intensity calculation of the halo pattern.

An important point of the invention is that the charge generation layer and the charge transport layer are regulated so as to satisfy the above condition. Materials composing these layers can be appropriately selected from commonly used materials, and not limited to special materials. Specific materials and structures of other components including a conductive substrate are also not restricted by any special limitation, and can be selected from commonly used articles as required. Some specific examples are given in the following.

The charge generation layer can be composed of an organic pigment together with a resin binder. Preferred materials can be selected from metal free phthalocyanines with various crystal forms, and various phthalocyanines having a central metal of copper, aluminum, indium, vanadium, or titanium, and bisazo and trisazo pigments. A more preferable material is titanylphthalocyanine having a crystal form classified to phase II as studied by W. Hiller. These organic pigments are used regulating the particle diameter in the range of 50 to 800 nm, preferably in the range of 150 nm to 300 nm, and dispersed in a binder resin. Performance of the charge generation layer is affected by a binder resin. The binder resin is appropriately selected from poly(vinyl chloride), poly(vinyl butyral), poly(vinyl acetal), polyester, polycarbonate, acrylic resin, and phenoxy resin. A thickness of the charge generation layer is preferably in the range of 0.1 to 5 μm, more preferably in the range of 0.2 to 0.5 μm.

To achieve a favorable dispersion condition and form a homogeneous charge transport layer, a solvent for the coating liquid must be adequately selected. The solvent in the invention can be selected from aliphatic hydrocarbon halides such as methylene chloride and 1,2-dichroloethane, etherized hydrocarbons such as tetrahydrofuran and 1,3-dioxorane, ketones such as acetone, methyl ethyl ketone, and cyclohexanone, and esters such as ethyl acetate and ethyl cellosolve. The proportions of the charge generation agent and the binder resin in the coating liquid are preferably adjusted such that the binder resin is in the range of 30 to 70 wt % in the charge generation layer after coating and drying. A particularly favorable composition of the charge generation layer is 50 wt % of binder resin and 50 wt % of charge generation agent.

The materials as described above are appropriately combined to prepare a coating liquid for a charge generation layer. The coating liquid is then treated with an apparatus for dispersion treatment such as a sand mill or a paint shaker, to adjust the grain diameter of the pigment particles at a desired size, and used in the coating process.

A charge transport layer is formed by applying charge transport agent itself or a coating liquid containing a charge transport agent and a binder resin dissolved in an adequate solvent. The application process is conducted on the charge generation layer by a dipping process or a process using an applicator, followed by drying process to obtain a charge transport layer. For a photoconductor in the invention, a charge transport layer is preferably formed by a dipping process.

The charge transport agent can be appropriately selected from hole transport substances or electron transport substances according to the system for electrifying the photoconductor in copiers, printers, or facsimile machines. Such hole transport materials include hydrazone compounds, styryl compounds, diamine compounds, butadiene compounds, indole compounds, and a mixture of these materials; the electron transport materials include benzoquinone derivatives, phenanthrenequinone derivatives, stilbenequinone derivatives, and azoquinone derivatives.

When the charge generation agent used is a titanylphthalocyanine, a charge transport agent has preferably a partial structure of hexahydrocyclopentaindole skeleton that can be substituted by aliphatic hydrocarbon, an aromatic hydrocarbon, or a halogen. Such a charge transport agent gives particularly favorable results.

For a binder resin to form a charge transport layer together with the charge transport agent, polycarbonate polymers are commonly used from the viewpoints of film strength and wear resistance. The polycarbonate polymers include bisphenols A, C, and Z. Copolymers consisting of monomer units composing these polycarbonate polymers can be also used. Adequate molecular weight of the polycarbonate polymers ranges from 10,000 to 100,000. Other substances that can be used for binder resin in a charge transport layer include polyethylene, polyphenylene ether, acrylic resin, polyester, polyamide, polyurethane, epoxy resin, poly(vinyl acetal), poly(vinyl butyral), phenoxy resin, silicone resin, poly(vinyl chloride), poly(vinylidene chloride), poly(vinyl acetate), cellulose resin, and copolymers of these substances. The thickness of the charge transport layer is preferably in the range of 3 to 50 μm considering electrification characteristics and wear resistance of the photoconductor. Silicone oil can be adequately added to give surface smoothness. A surface protective layer can be additionally provided on the charge transport layer as required.

A conductive substrate can be composed of a drum of a metal such as aluminum, or a film of conductive plastics. Or glass or a molded article or a sheet made of acrylic resin, polyamide, or poly(ethylene terephthalate) can also be used with an electrode provided on the surface thereof.

An undercoat layer can be composed of an insulating polymer such as casein, poly(vinyl alcohol), poly(vinyl acetal), nylon, melamine, or cellulose, a conductive polymer such as polythiophene, polypyrrole, poly(phenylene vinylene), or polyaniline, or one of these polymers containing a metal oxide such as titanium dioxide or zinc oxide. Alumite formed on the conductive substrate can also be used for an undercoat layer.

EXAMPLES

The present invention will be described with reference to specific photoconductor production examples and examples of preferred embodiments. The invention, however, shall not be limited to those examples.

Photoconductor Production Example 1

A slurry was produced by dissolving 0.25 kg of vinyl phenol resin (Marukalyncur MH-2, a product of Maruzen Petrochemical Co., Ltd.) and 0.25 kg of a melamine resin (Uvan 2021, a product of Mitsui Chemicals, Inc.) in a mixed solvent of 7.5 kg of methanol and 1.5 kg of butanol, and adding 0.5 kg of aminosilane-treated fine particles of titanium oxide. This slurry was treated circulating 10 times amount of the treatment liquid and using a disk type beads mill containing zirconia beads with a diameter of 0.5 μm in a filling factor of 85 v/v % with respect to the vessel capacity at a flow rate of the treatment liquid of 400 ml/min and a disk peripheral velocity of 3 m/s. Thus, a coating liquid for an undercoat layer was prepared.

The coating liquid for undercoat layer was dip-coated on a cylindrical aluminum substrate to form an undercoat layer. After drying at 145° C. for 30 min, an undercoat layer having a dried thickness of 5 μm was obtained.

Then, a coating liquid for charge generation layer was prepared. First, slurry was produced by dissolving 50 g of poly(vinyl butyral) in 4.85 kg of tetrahydrofuran, and subsequently adding 100 g of titanylphthalocyanine having a crystal form classified to the phase II that had been studied by W. Hiller and had a specific gravity of 1.57 (W. Hiller et al., Z. Kristallogr. vol. 159, p. 173 (1982), herein incorporated by reference). This slurry was treated circulating 15 times amount of the treatment liquid using an annular type beads mill containing glass beads with a diameter of 0.5 μm in a filling factor of 85 v/v % with respect to the vessel capacity at a flow rate of the treatment liquid of 400 ml/min and a disk peripheral velocity of 1 m/s. Thus, a coating liquid for a charge generation layer was prepared.

The coating liquid for charge generation layer was coated on a cylindrical aluminum substrate having the undercoat layer to form a charge generation layer. After drying at 80° C. for 30 min, a charge generation layer having a dried thickness of 0.1 to 0.5 μm was obtained.

A coating liquid for the charge transport layer was prepared by dissolving 9 wt % of a charge transport agent that was a compound disclosed in Japanese Patent No. 2812729 and represented by the following structural formula (1), and 11 wt % of a binder resin that is a polycarbonate resin (Toughzet B-500, a product of Idemitsu Kosan Co., Ltd.) dissolved in 80 wt % of dichloromethane.

(1)

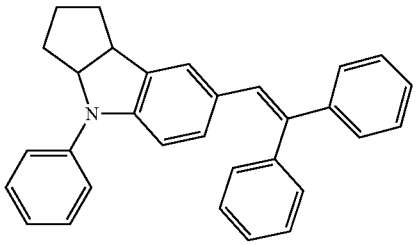

The coating liquid was dip-coated on the charge generation layer and dried at 90° C. for 60 min to form a charge transport layer 20 μm thick. Thus, an electrophotographic photoconductor was produced.

Photoconductor Production Example 2

A photoconductor sample was produced as in Photoconductor production example 1 using a coating liquid for charge transport layer that was prepared in the same manner as in Photoconductor production example 1 except that a compound disclosed in Japanese Patent No. 2812729 and represented by the following structural formula (2) was used in place of the compound represented by the structural formula (1).

(2)

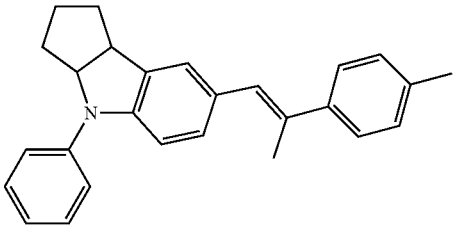

Photoconductor Production Example 3

A photoconductor sample was produced as in Photoconductor production example 1 using a coating liquid for charge transport layer that was prepared in the same manner as in Photoconductor production example 1 except that a compound disclosed in Japanese Patent No. 2812729 and represented by the following structural formula (3) was used in place of the compound represented by the structural formula (1).

(3)

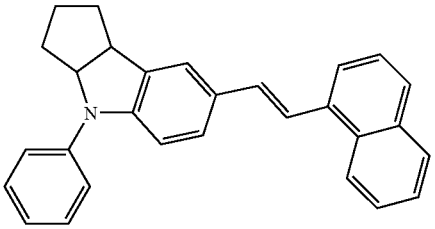

Photoconductor Production Example 4

A photoconductor sample was produced as in Photoconductor production example 1 using a coating liquid for charge transport layer that was prepared in the same manner as in Photoconductor production example 1 except that a compound disclosed in Japanese Patent No. 2812729 and represented by the following structural formula (4) was used in place of the compound represented by the structural formula (1).

(4)

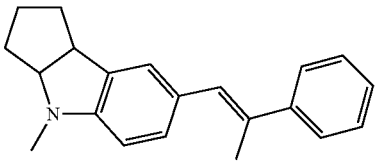

Photoconductor Production Example 5

A photoconductor sample was produced as in Photoconductor production example 1 using a coating liquid for charge transport layer that was prepared in the same manner as in Photoconductor production example 1 except that a compound disclosed in Japanese Patent No. 2806567 and represented by the following structural formula (5) was used in place of the compound represented by the structural formula (1).

(5)

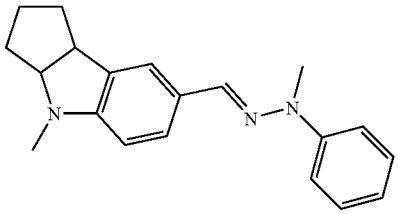

Photoconductor Production Example 6

A photoconductor sample was produced as in Photoconductor production example 1 using a coating liquid for charge transport layer that was prepared in the same manner as in Photoconductor production example 1 except that a compound disclosed in Japanese Patent No. 2806567 and represented by the following structural formula (6) was used in place of the compound represented by the structural formula (1).

(6)

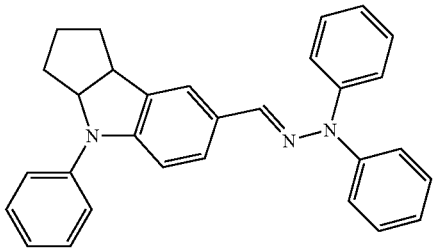

Photoconductor Production Example 7

A photoconductor sample was produced as in Photoconductor production example 1 using a coating liquid for charge transport layer that was prepared in the same manner as in Photoconductor production example 1 except that a compound disclosed in Japanese Patent No. 2806567 and represented by the following structural formula (7) was used in place of the compound represented by the structural formula (1).

(7)

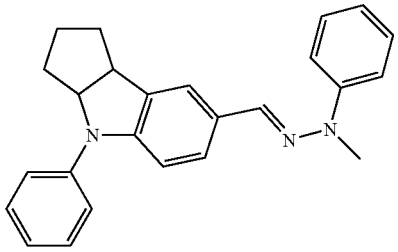

Photoconductor Production Example 8

A photoconductor sample was produced as in the Photoconductor production example 1 using a coating liquid for charge transport layer that was prepared in the same manner as in Photoconductor production example 1 except that a compound disclosed in Japanese Patent No. 2806567 and represented by the following structural formula (8) was used in place of the compound represented by the structural formula (1).

(8)

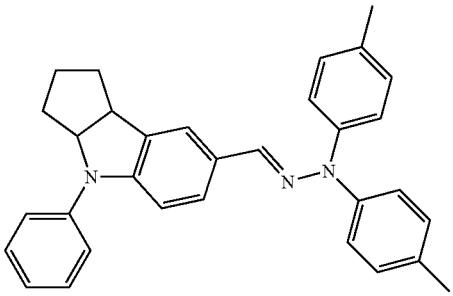

Photoconductor Production Example 9

A photoconductor sample was produced as in Photoconductor production example 1 using a coating liquid for charge transport layer that was prepared in the same manner as in Photoconductor production example 1 except that a compound disclosed in Japanese Patent No. 2886493 and represented by the following structural formula (9) was used in place of the compound represented by the structural formula (1).

(9)

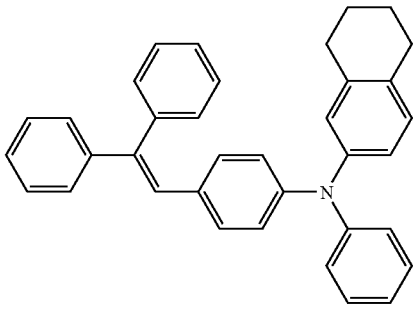

Photoconductor Production Example 10

A photoconductor sample was produced as in Photoconductor production example 1 using a coating liquid for charge transport layer that was prepared in the same manner as in Photoconductor production example 1 except that a compound disclosed in Japanese Patent No. 2886493 and represented by the following structural formula (10) was used in place of the compound represented by the structural formula (1).

(10)

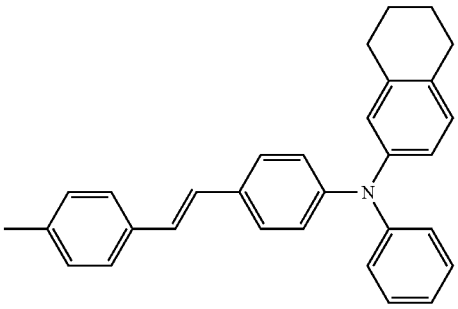

Photoconductor Production Example 11

A photoconductor sample was produced as in Photoconductor production example 1 using a coating liquid for charge transport layer that was prepared in the same manner as in Photoconductor production example 1 except that a compound disclosed in Japanese Patent No. 2886493 and represented by the following structural formula (11) was used in place of the compound represented by the structural formula (1).

(11)

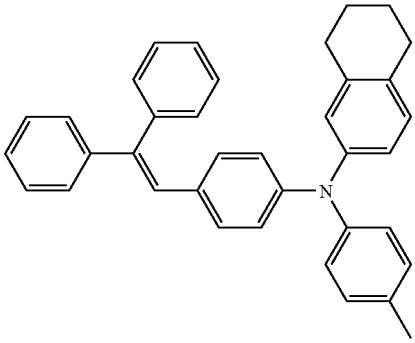

Photoconductor Production Example 12

A photoconductor sample was produced as in Photoconductor production example 1 using a coating liquid for charge transport layer that was prepared in the same manner as in Photoconductor production example 1 except that a compound represented by the following structural formula (12) was used in place of the compound represented by the structural formula (1).

(12)

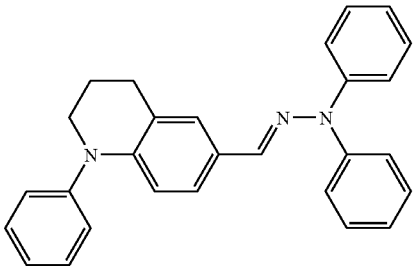

Photoconductor Production Example 13

A photoconductor sample was produced as in Photoconductor production example 1 using a coating liquid for charge transport layer that was prepared in the same manner as in Photoconductor production example 1 except that a compound represented by the following structural formula (13) was used in place of the compound represented by the structural formula (1).

(13)

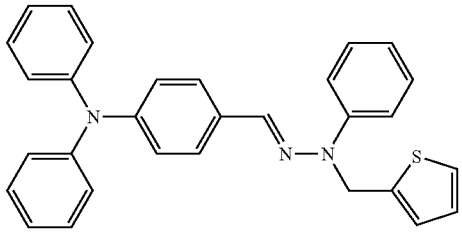

Measurement was made on a solid component proportion of the coating liquid for charge generation layer produced in Photoconductor production example 1. The coating liquid in an amount of 1.5 g was taken out into a 20 ml glass bottle and air dried to roughly eliminate solvent, and then further died at 120° C. for 120 min. Comparing the weight of the coating liquid after the drying process with the weight of the coating liquid before the drying process, a solid component proportion was determined assuming the weight of the coating liquid after the drying process was the weight of a solid component that was the sum of the weight of titanylphthalocyanine, a charge generation agent, and the weight of butyral resin, a binder resin. From the ratio of blend of the charge generation agent and the binder resin, the actual weight concentration of the titanylphthalocyanine in the coating liquid was determined to be 1.2 wt %. Using this measurement result, a test coating liquid was produced by adding the charge transport agent used in each of the Photoconductor production examples 1 through 13, in the same mass as the mass of the charge generation agent, into the coating liquid for charge generation layer. A coating liquid for charge generation layer without adding a charge transport agent was separately prepared.

About 6 ml of each test coasting liquid divided to several portions was dropped and air-dried repeatedly on an aluminum plate coated with a film of nylon resin about 0.8 μm thick, to obtain test pieces (coating films) with an area of about 2 cm square. After air-drying, the test pieces were further dried at 80° C. for 30 min. The resulting test pieces had a film thickness of about 1 mm.

On the thus obtained test pieces, X-ray diffraction measurement was conducted using a radiation source of Cu Kα line and a diffraction pattern was obtained for each test piece. From the obtained diffraction pattern, the intensity ratio of the halo pattern to the maximum diffraction peak was calculated according to the method described previously.

The photoconductors produced in the Photoconductor production examples were installed on a printer on the market with a resolving power of 600 dpi employing a contact electrification system and a developing system using nonmagnetic single component toner, and printing tests were conducted in a low temperature and low humidity environment of the temperature of 10° C. and the relative humidity of 20%, in which ghost phenomena caused by exposure tends to be significant and the variation of bright potential is apt to be affected by hole mobility.

Image samples were obtained on sheets of paper by printing a pattern of images that includes a black pattern in a region corresponding to a first revolution of the drum and a half tone image in a region corresponding to a second revolution and thereafter. In this condition, a ghost phenomenon caused by exposure occurs in which the black pattern in the first revolution of the drum appears as an after-image in the half-tone images printed in second revolution and thereafter. So, the extent of ghost phenomena caused by exposure was evaluated by mean density difference between the after-image part in the half-tone image and the normally printed part at three points. The density of printings was measured by a densitometer RD918, a product of Gretag-Macbeth AG. The difference in bright potential just after initial printing and after 10,000 sheets of printings was measured on each of the photoconductor samples.

The results of the evaluations described above are summarized in Table 1.

TABLE 1

| | photoconductor sample (*3) | intensity ratio (*4) | density difference (*5) | bright potential difference (V) |
|---|---|---|---|---|
| Emb Ex 1 (*1) | Production example 1 (*3) | 0.18 | 0.00 | 5 |
| Emb Ex 2 | Production example 2 | 0.23 | 0.02 | 5 |
| Emb Ex 3 | Production example 3 | 0.21 | 0.00 | 3 |
| Emb Ex 4 | Production example 4 | 0.22 | 0.00 | 3 |
| Emb Ex 5 | Production example 5 | 0.25 | 0.02 | 3 |
| Emb Ex 6 | Production example 6 | 0.28 | 0.04 | 4 |
| Emb Ex 7 | Production example 7 | 0.27 | 0.03 | 5 |
| Emb Ex 8 | Production example 8 | 0.28 | 0.04 | 4 |
| Comp Ex 1 (*2) | Production example 9 | 0.35 | 0.15 | 13 |
| Comp Ex 2 | Production example 10 | 0.38 | 0.18 | 15 |
| Comp Ex 3 | Production example 11 | 0.45 | 0.22 | 20 |
| Comp Ex 4 | Production example 12 | 0.30 | 0.13 | 12 |
| Comp Ex 5 | Production example 13 | 0.50 | 0.25 | 21 |

(*1) Embodiment Example 1
(*2) Comparative Example 1
(*3) Photoconductor production example
(*4) Intensity ratio of the maximum intensity of halo pattern to the maximum diffraction peak
(*5) Density difference between a memory part and a normal part As is apparent in Table 1, it has been confirmed that if the intensity ratio of the maximum intensity of halo pattern to the maximum diffraction peak is less than 0.3 in X-ray diffraction measurement using a radiation source of Cu Kα line obtained for test pieces of photoconductor samples, a photoconductor can be obtained that does not generate a ghost phenomenon caused by exposure and exhibits small potential change before and after continuous printings.

The invention may of course be practiced otherwise than as specifically described without departing from the scope thereof.

What is claimed is:

1. An electrophotographic photoconductor that is a functionally separated type electrophotographic photoconductor, comprising:

a conductive substrate;

a charge generation layer containing a charge generation agent in crystalline form; and a charge transport layer containing a charge transport agent, wherein the charge generation layer and the charge transport layer are sequentially laminated on the conductive substrate, and wherein the electrophotographic photoconductor has an intensity ratio of less than 0.30, which correlates with little or no charge generation agent in an amorphous state so that the electrophotographic photoconductor is substantially free of ghost phenomenon and potential change before and after continuous printing, the intensity ratio being a ratio of the maximum intensity of a halo pattern to a peak intensity of a maximum diffraction peak in an X-ray diffraction pattern obtained by a powder method using Cu Kα line of a test coating film produced from a test coating liquid that is prepared by adding the charge transport agent into a coating liquid for the charge generation layer in an equal mass of the charge transport agent to a mass of the charge generation agent.

2. The electrophotographic photoconductor according to claim 1, wherein the charge generation agent comprises a titanylphthalocyanine having a phase II triclinic crystal form as defined herein.

3. The electrophotographic photoconductor according to claim 2, wherein the charge transport layer is a dip coated layer formed by a dip coating method.

4. The electrophotographic photoconductor according to claim 2, wherein the charge transport agent has a partial structure of a hexahydrocyclopentaindole skeleton substituted by at least one of the group consisting of an aliphatic hydrocarbon, an aromatic hydrocarbon, and a halogen.

5. The electrophotographic photoconductor according to claim 1, wherein the charge transport layer is a dip coated layer formed by a dip coating method.

6. The electrophotographic photoconductor according to claim 1, wherein the charge transport layer has a thickness in the range of 3 to 50 μm.

7. The electrophotographic photoconductor according to claim 1, wherein the charge generation layer has a thickness in the range of 0.1 to 5 μm.

8. The electrophotographic photoconductor according to claim 7, wherein the charge generation layer has a thickness in the range of 0.2 to 0.5 μm.

9. The electrophotographic photoconductor according to claim 1, wherein the charge generation agent comprises at least one organic pigment selected from the group consisting of (a) metal free phthalocyanines (b) phthalocyanines having a central metal that is one of copper, aluminum, indium, vanadium, or titanium, (c) bisazo pigments, and (d) trisazo pigments.

10. The electrophotographic photoconductor according to claim 9, wherein the charge transport agent has a partial structure of a hexahydrocyclopentaindole skeleton substituted by at least one of the group consisting of an aliphatic hydrocarbon, an aromatic hydrocarbon, and a halogen.

11. The electrophotographic photoconductor according to claim 1, wherein the charge transport agent has a partial structure of a hexahydrocyclopentaindole skeleton substituted by at least one of the group consisting of an aliphatic hydrocarbon, an aromatic hydrocarbon, and a halogen.

12. An electrophotographic photoconductor that is a functionally separated type electrophotographic photoconductor, comprising:

a conductive substrate;

a charge generation layer containing a charge generation agent comprised of at least one organic pigment in crystalline form and selected from the group consisting of (a) metal free phthalocyanines, (b) phthalocyanines having a central metal that is one of copper, aluminum, indium, vanadium, or titanium, (c) bisazo pigments, and (d) trisazo pigments; and a charge transport layer containing a charge transport agent comprised of a substance having a partial structure of a hexahydrocyclopentaindole skeleton substituted by at least one of the group consisting of an aliphatic hydrocarbon, an aromatic hydrocarbon, and a halogen, wherein the charge generation layer and the charge transport layer are sequentially laminated on the conductive substrate, and wherein the electrophotographic photoconductor has an intensity ratio of less than 0.30 as defined herein, which correlates with little or no charge generation agent in an amorphous state so that the electrophotographic photoconductor is substantially free of ghost phenomenon and potential change before and after continuous printing.

13. The electrophotographic photoconductor according to claim 12, wherein the charge generation agent comprises a titanylphthalocyanine having a phase II triclinic crystal form as defined herein.

14. The electrophotographic photoconductor according to claim 12, wherein the charge transport layer is a dip coated layer formed by a dip coating method.

15. An electrophotographic photoconductor that is a functionally separated type electrophotographic photoconductor, comprising:

a conductive substrate;

a charge generation layer containing a charge generation agent consisting essentially of at least one organic pigment in crystalline form and selected from the group consisting of (a) metal free phthalocyanines, (b) phthalocyanines having a central metal that is one of copper, aluminum, indium, vanadium, or titanium, (c) bisazo pigments, and (d) trisazo pigments; and a charge transport layer containing a charge transport agent consisting essentially of a substance having a partial structure of a hexahydrocyclopentaindole skeleton substituted by at least one of the group consisting of an aliphatic hydrocarbon, an aromatic hydrocarbon, and a halogen, wherein the charge generation layer and the charge transport layer are sequentially laminated on the conductive substrate, and wherein the electrophotographic photoconductor has an intensity ratio of less than 0.30 as defined herein, which correlates with little or no charge generation agent in the amorphous state so that the electrophotographic photoconductor is substantially free of ghost phenomenon and potential change before and after continuous printing.

16. The electrophotographic photoconductor according to claim 15, wherein the charge generation agent consists essentially of a titanylphthalocyanine having a phase II triclinic crystal form as defined herein.

17. The electrophotographic photoconductor according to claim 15, wherein the charge transport layer is a dip coated layer formed by a dip coating method.

18. The electrophotographic photoconductor according to claim 15, wherein the charge generation agent consists of the at least one organic pigment.

19. The electrophotographic photoconductor according to claim 15, wherein the charge generation agent consists of a titanylphthalocyanine having a phase II triclinic crystal form as defined herein.

* * * * *

UNITED STATES PATENT AND TRADEMARK OFFICE

CERTIFICATE OF CORRECTION

PATENT NO. : 7,662,529 B2
APPLICATION NO. : 11/520038
DATED : February 16, 2010
INVENTOR(S) : Mikio Yamazaki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 729 days.

Signed and Sealed this

Thirtieth Day of November, 2010

David J. Kappos

David J. Kappos
*Director of the United States Patent and Trademark Office*